US007731579B2

(12) United States Patent
Gomez et al.

(10) Patent No.: US 7,731,579 B2
(45) Date of Patent: Jun. 8, 2010

(54) WAGERING GAME WITH POST-REVEAL ALTERATION OF THE AWARD

(75) Inventors: Benjamin T. Gomez, Chicago, IL (US); Michael P. Casey, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1123 days.

(21) Appl. No.: 10/935,328

(22) Filed: Sep. 7, 2004

(65) Prior Publication Data

US 2006/0052151 A1 Mar. 9, 2006

(51) Int. Cl.
*A63F 9/24* (2006.01)

(52) U.S. Cl. ..... 463/16; 463/20

(58) Field of Classification Search ..... 463/16, 463/9, 20, 25; 273/143 R, 138.1, 138.2, 273/293, 274, 309
See application file for complete search history.

(56) References Cited

U.S. PATENT DOCUMENTS

| | | | | |
|---|---|---|---|---|
| 5,580,055 | A | 12/1996 | Hagiwara | |
| 5,788,573 | A | 8/1998 | Baerlocher | |
| 5,882,261 | A | 3/1999 | Adams | |
| 5,931,467 | A | 8/1999 | Kamille | |
| 5,980,384 | A | 11/1999 | Barrie | |
| 6,012,982 | A | 1/2000 | Piechowiak et al. | |
| 6,047,963 | A | 4/2000 | Pierce | |
| 6,089,976 | A * | 7/2000 | Schneider et al. | 463/16 |
| 6,089,978 | A * | 7/2000 | Adams | 463/20 |
| 6,190,255 | B1 | 2/2001 | Thomas et al. | |
| 6,254,481 | B1 | 7/2001 | Jaffe | |
| 6,375,187 | B1 * | 4/2002 | Baerlocher | 273/143 R |
| 6,413,161 | B1 * | 7/2002 | Baerlocher et al. | 463/20 |
| 6,511,375 | B1 * | 1/2003 | Kaminkow | 463/20 |
| 6,582,306 | B1 | 6/2003 | Kaminkow | |
| 6,776,711 | B1 * | 8/2004 | Baerlocher | 463/16 |
| 2004/0023707 | A1 * | 2/2004 | Maya et al. | 463/16 |
| 2004/0053676 | A1 * | 3/2004 | Rodgers | 463/20 |
| 2004/0072615 | A1 * | 4/2004 | Maya et al. | 463/26 |
| 2004/0127281 | A1 * | 7/2004 | Fong et al. | 463/20 |
| 2005/0054416 | A1 * | 3/2005 | Hostetler et al. | 463/16 |

* cited by examiner

*Primary Examiner*—Peter DungBa Vo
*Assistant Examiner*—Masud Ahmed
(74) *Attorney, Agent, or Firm*—Nixon Peabody LLP

(57) ABSTRACT

The present invention is directed to a gaming terminal and a method of playing a wagering game. The wagering game may include a basic game and a bonus game that includes selectable objects. The objects can be selected by a player or by a computer. Each of the selectable objects is associated with a bonus award. During game play, a player or computer selects objects until a predetermined number of selections occurs or a stop-selection feature occurs. After selection ends, the bonus awards associated with the selected objects are displayed. Subsequently, the awards associated with the non-selected objects may be revealed. At this time, instead of the game ending, at least one of the awards associated with the selected objects is altered, producing an adjusted bonus award for that selection. The player receives an overall bonus award that is based on the adjusted bonus awards.

77 Claims, 12 Drawing Sheets

WAGERING GAME WITH POST-REVEAL ALTERATION OF THE AWARD

FIELD OF THE INVENTION

The present invention relates generally to gaming terminals and methods of playing wagering games at the gaming terminals and, more particularly, to a gaming terminal and method of playing a wagering game at the gaming terminal whereby an award associated with one or more selectable objects is altered after the awards for selected and non-selected objects are revealed.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

In some basic games, bonus games, and progressive games, players are allowed to make selections that influence the progression of the game and/or the award that they receive when game play is over. This has the benefit of allowing a player to feel like they have some control over the outcome of the game, or at least the final award. After a player has made his or her selections, the awards associated with those selections are revealed to the player. In addition to revealing the awards that the player has won, a game may also reveal the awards associated with the selections that the player did not make. For example, in one prior game a player is allowed to select three out of a total of five selectable objects. After picking three of the objects, the awards associated with the three selected objects are revealed. Subsequent to revealing these awards, the game may also reveal the awards associated with the two objects that the player did not select. In these prior games, once the awards associated with the selected and non-selected objects are revealed, the player receives the awards for the selected objects and the game is over. At this point, the excitement level associated with playing the game is diminished, if not ended.

The present invention provides further enhancement of the gaming experience by increasing the anticipation of future winnings even after the a player has made his or her selections. The present invention provides for alteration of an award after the selected and non-selected objects have been revealed. Thus, a player's expectation that a gaming session is over and an award has been set is replaced with an enhanced anticipation of a larger award via alteration of the award after it has been revealed.

SUMMARY OF THE INVENTION

According to one embodiment of the present invention, the needs mentioned above are met by a gaming terminal having a basic game and a bonus game. The basic game has a plurality of symbols that indicate a randomly selected outcome that has been selected from a plurality of outcomes in response to a wager input by a player. The bonus game has a plurality of selectable objects. The selectable objects are associated with bonus awards. The bonus awards are displayed upon selection. Upon display of bonus awards that are associated with selected objects, at least one of the bonus awards associated with a non-selected object is revealed. Thereafter, at least one of the displayed bonus awards undergoes a random alteration to produce an adjusted bonus award.

According to another embodiment of the invention, a method of playing a wagering game is disclosed. The method includes conducting a basic game and a bonus game at a gaming terminal. The basic game has a plurality of symbols that indicates a randomly selected outcome that has been selected from a plurality of outcomes in response to a wager input by a player. Upon achieving a bonus-game outcome as a randomly selected outcome in the basic game, the bonus-game outcome provides a plurality of selectable objects in a bonus game. Each of the selectable objects is associated with a bonus award. The method further consists of receiving a selection of at least one of the plurality of selectable objects, displaying the bonus award associated with each of the selected objects, and revealing the bonus award associated with at least one non-selected object. After revealing a bonus award associated with at least one of the non-selected objects, at least one of the displayed bonus awards is randomly altered to provide an adjusted bonus award.

According to another embodiment of the invention, a method of playing a wagering game includes displaying a plurality of selectable objects that are each associated with an award. At least one of the plurality of selectable objects is selected and the awards associated with the selected objects are displayed. The awards associated with each non-selected object are also revealed. After the awards associated with the non-selected objects are revealed, the displayed awards associated with at least one of the selected objects are randomly altered.

According to another embodiment of the invention, a gaming terminal for playing a wagering game includes a display and a controller. The display is useful for displaying a plurality of selectable objects. Each selectable object is associated with an award. The controller is coupled to the display and operates to control the selection of at least one of the plurality of selectable objects and display an award associated with each selected object. The controller also operates to reveal awards associated with non-selected objects. Once the awards associated with non-selected objects are revealed, the controller operates to alter at least one of the awards associated with a selected object to provide an adjusted award.

According to another embodiment of the invention, a method of playing a wagering game includes displaying a plurality of selectable objects that are each associated with an award and selecting at least one of the plurality of selectable objects. After the awards associated with each selected object are displayed, the awards associated with at least one of the non-selected objects are revealed and the displayed awards associated with at least one of the selected objects is randomly altered.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
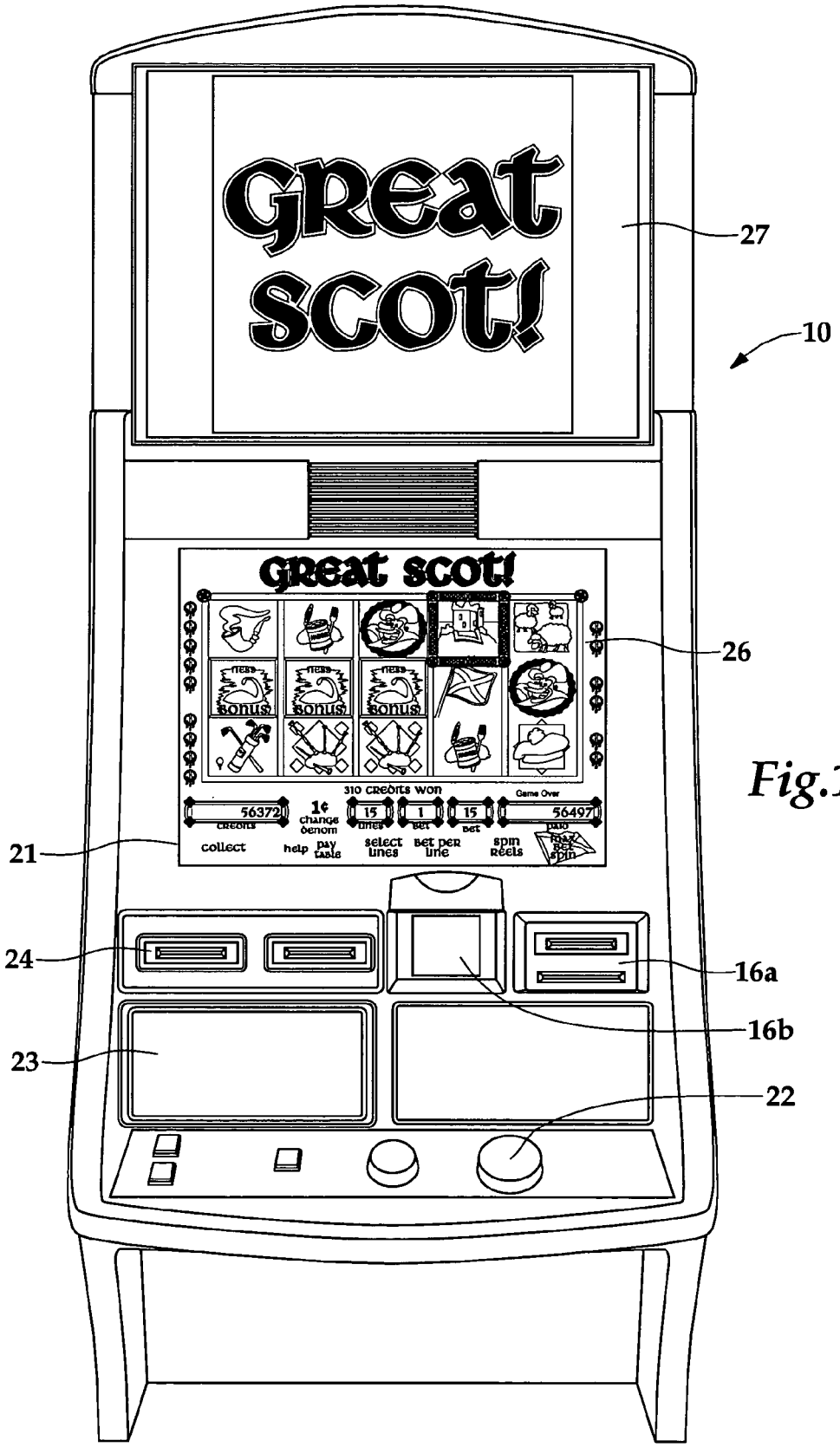
FIG. 1 is a perspective view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The present invention is directed to a gaming terminal and a method of playing a wagering game. The wagering game may include a basic game and a bonus game that includes selectable objects. The objects can be selected by a player or by a computer. Each of the selectable objects is associated with a bonus award. During game play, a player or computer selects objects until a predetermined number of selections occurs or a stop-selection feature occurs. After selection ends, the bonus awards associated with the selected objects are revealed, and a total award may be displayed to a player. Subsequently, the awards associated with the non-selected objects may also be revealed, indicating what a player would have received had he or she selected those objects. After revealing the non-selected awards, instead of the game ending, the awards associated with the selected objects are altered. This alteration provides an adjusted award, and the player receives an overall bonus award that is based on the adjusted bonus awards.

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager accepter 16*b*), a touch screen 21, a push-button panel 22, and an information reader 24. For outputs, the gaming terminal 10 includes a payout mechanism 23, a main display 26 for displaying information about the basic wagering game, and a secondary display 27 that may display an electronic version of a pay table, a bonus game and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

Also included is the payout mechanism 23, which performs the reverse functions of the wager acceptor. For example, the payout mechanism 23 may include a coin dispenser or a note dispenser to output value from gaming terminal 10. Also, the payout mechanism 23 may also be adapted to receive a card that authorizes the gaming terminal to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome, as well.

In some embodiments, the information reader 24 is a card reader that allows for identification of a player by reading a card with information indicating his or her true identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10. The information reader 24 may also include a keypad (not shown) for entering a personal identification number (PIN). The gaming terminal 10 may require that the player enter their PIN prior to obtaining information. The gaming terminal 10 may use the secondary display 27 for providing the player with information about his or her account or other player-specific information. Also, in some embodiments, the information reader 24 may be used to restore assets that the player achieved during a previous game session and had saved.

Figure 2:
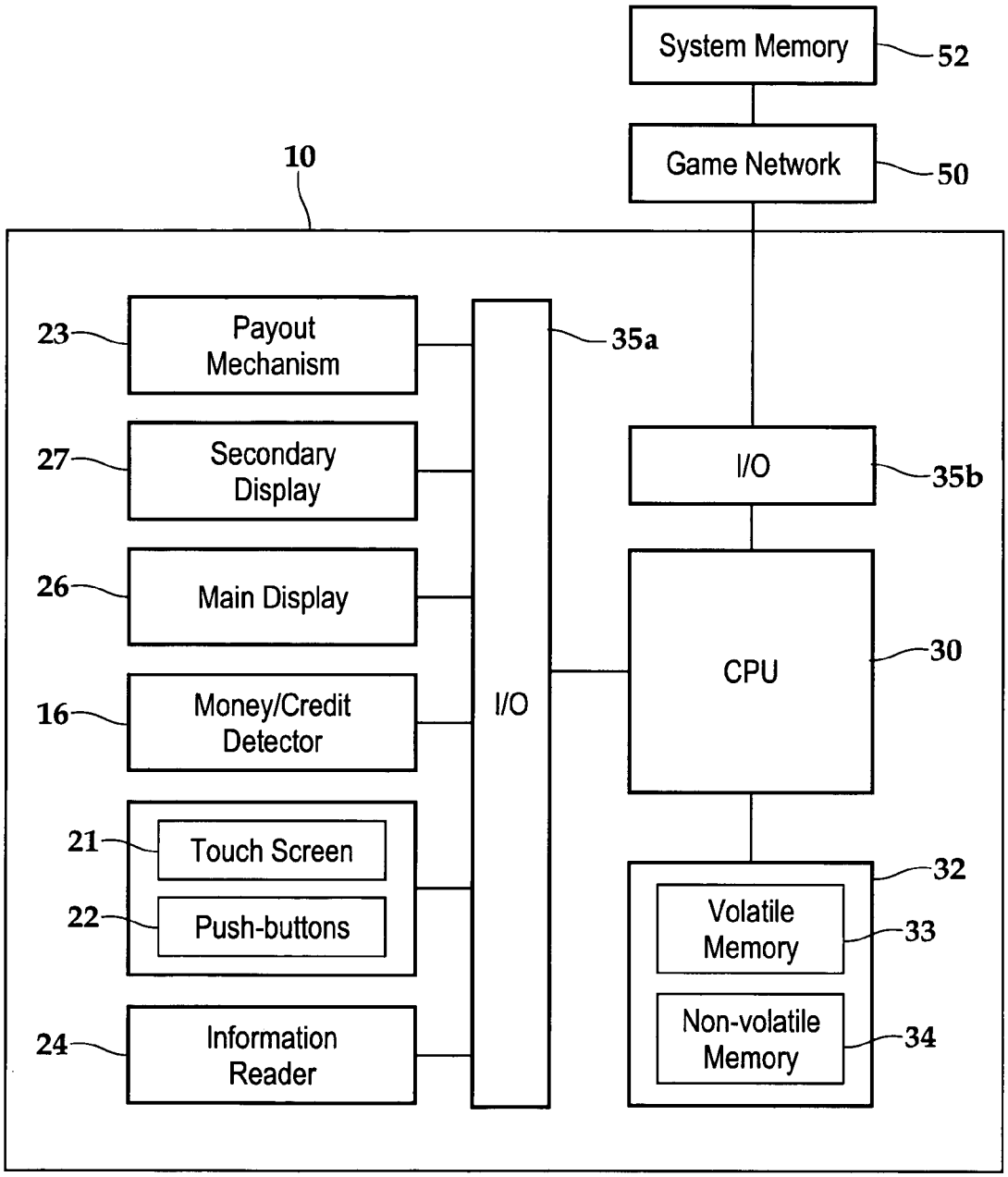
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes a game program that allows for the randomly selected outcome. The CPU 30 is also coupled to or includes a local memory 32. The local memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the local memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

In some embodiments, the CPU 30 may not be inside the gaming terminal 10. Instead, the CPU 30 may be part of a game network 50 (FIG. 2) and may be used to control numerous gaming terminals 10. In these embodiments, the CPU 30 will run the basic games for each of the gaming terminals 10, and may also be used to link the gaming terminals 10 together. The game network 50 can include progressive jackpots that are contributed to by all or some of the gaming terminals 10 in the network (e.g., terminal-level jackpots that only each terminal 10 contributes to, bank-level jackpots that are contributed to by all of the terminals 10 in a particular bank, and wide-area jackpots that are contributed to by a larger number of terminals 10, such as multiple banks). Alternatively, the game network 50 can allow the player to retrieve assets obtained while playing at one gaming terminal 10 at a different gaming terminal that is also part of the game network 50. Assets may be any number of things, including, but not limited to, monetary or non-monetary awards, features that a player builds up in a bonus or progressive game to win awards, etc. In some embodiments, these assets can be saved by a player in a memory device and restored by the player in a later gaming session via a memory device located within or external to the gaming terminal.

It should be noted that the operation of the gaming terminal 10 can be controlled by a controller within the game network 50. As such, after receiving a wager at the gaming terminal 10, the random selection of the outcome occurs within the network 50. The network 50 then communicates the random outcome to the gaming terminal 10, which then displays symbols indicative of that outcome. In this alternative, the gaming terminal 10 is used for receiving inputs from the player and displaying outputs to the player.

Figure 3:
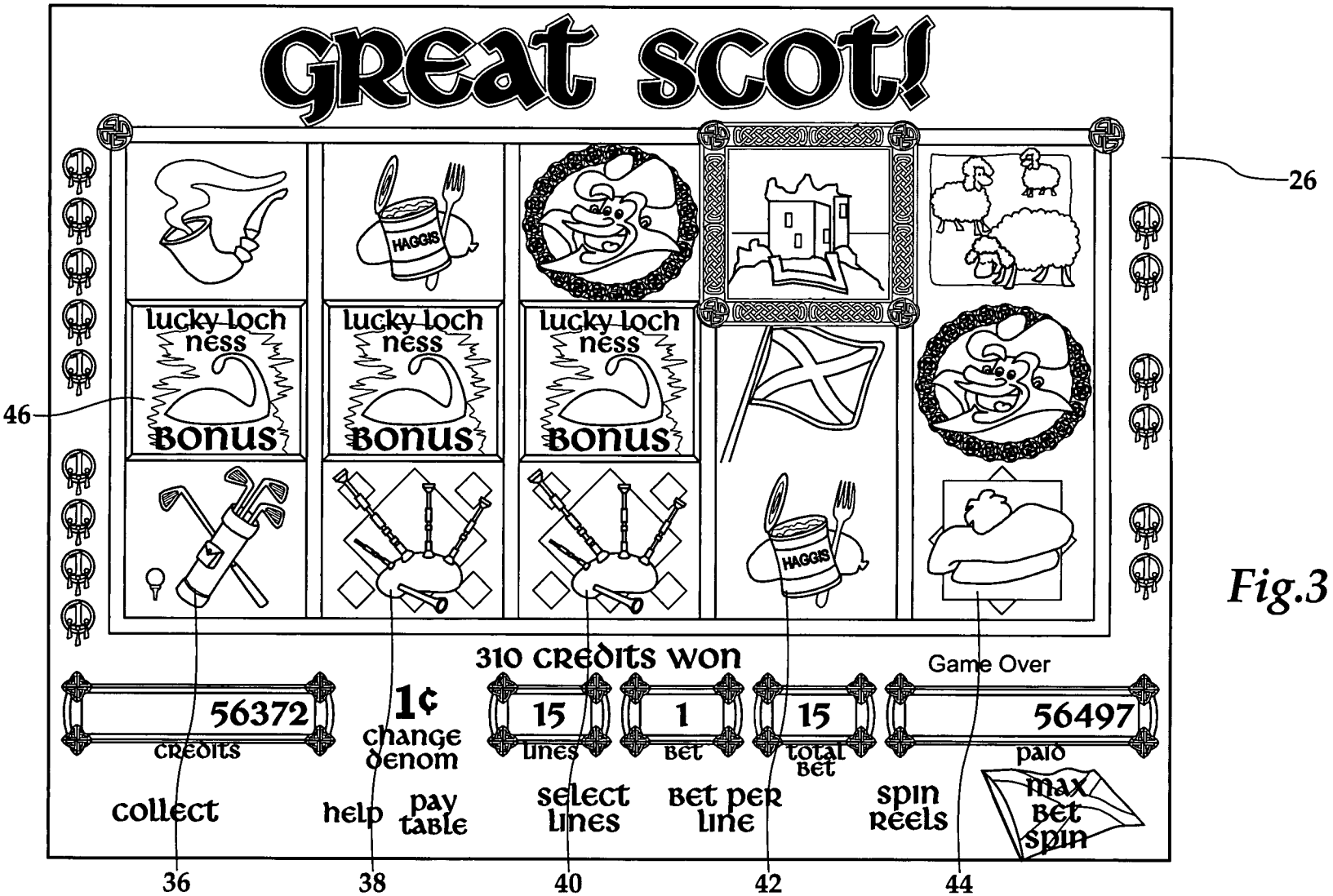
FIG. 3 illustrates a main display of a gaming terminal of FIG. 1 displaying one embodiment of a wagering game with a winning outcome according to the present invention.

The main display 26 of one embodiment of the present invention is shown in more detail in FIG. 3. In this embodiment, the basic wagering game is a slot machine game, with symbols on five different reels 36, 38, 40, 42, 44. The reels 36-44 may be either traditional mechanical reels or they may be computer-generated images of reels, with each reel composed of a plurality of symbols. Each of the paylines indicates a randomly selected outcome, which is the combination of symbols on the reels 36-44. While multiple paylines are shown, a gaming terminal 10 with a single payline will also work with the present invention.

The center payline 46 in FIG. 3 shows a combination of three bonus symbols on reels 36, 38, 40. This combination, as well as other combinations, indicates a bonus-game outcome in the basic game. The bonus game may be similar to or completely different from the basic wagering game. As will be discussed in more detail below, the basic game and the bonus game of the preferred embodiment of the present invention may have a Scottish theme that includes depictions of a "Lucky Loch Ness" or "Nessie" monster. FIG. 3, for example, includes several Scotland-related symbols, including a flag, golf clubs, a pipe, haggis, bagpipes, a castle, sheep, a cap and a Scottish character.

Figure 4:
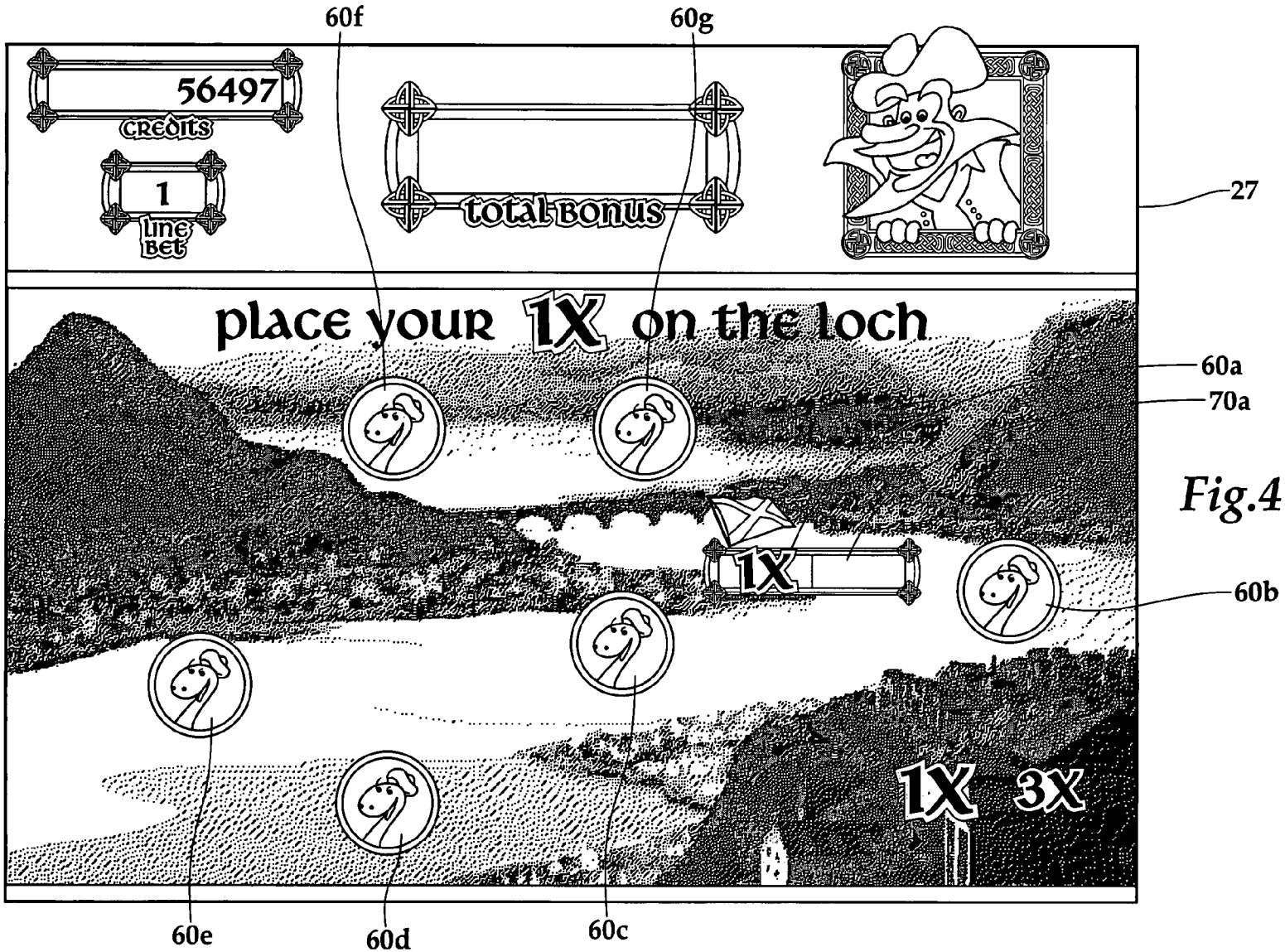
FIG. 4 illustrates a secondary display of a gaming terminal of FIG. 1 displaying one embodiment of a wagering game having selectable objects according to the present invention.

Once a player receives a combination of symbols that indicates a start-bonus-game outcome (as in FIG. 3), a bonus game may be displayed on the secondary display 27. FIG. 4 shows a bonus game of the preferred embodiment, depicting a loch (or lake) with a number of locations around the loch displaying selectable objects 60*a-g*. The selectable objects in FIG. 4 take the shape of a Loch Ness monster ("Nessie"), but may be any type of selectable object. Other selectable objects can include people, cities, bodies of water, land features or any other object that can be presented in a wagering game.

In the bonus game, a player or the CPU 30 is allowed to make a number of selections. The number of allowed selections may be based on the outcome in the basic game or some other random criteria. Alternatively, a player or the CPU 30 may be allowed to make selections until a stop-selection feature occurs. A stop-selection feature can include a selection that reveals a "pooper" item or other game-terminating outcome.

According to one embodiment of the present invention, as depicted in FIG. 4, the secondary display 27 displays seven selectable objects 60*a-g*, i.e. Nessie monsters. After a player or the CPU 30 makes a selection of one of the selectable objects, a multiplier meter 70 is placed at that location. The multiplier meter is associated with a multiplier, i.e. 1×, 2×, 3×, etc. In the preferred embodiment, this multiplier is used in the post-reveal alteration feature discussed below. In an alternative embodiment, the multiplier may be used prior to any post-reveal alteration that is performed, i.e. concurrent with the display of an award to increase the award before it is altered. Other embodiments of the present invention may include using different meters, with or without multipliers, or other items as a way of indicating when a selection has been made.

Figure 5:
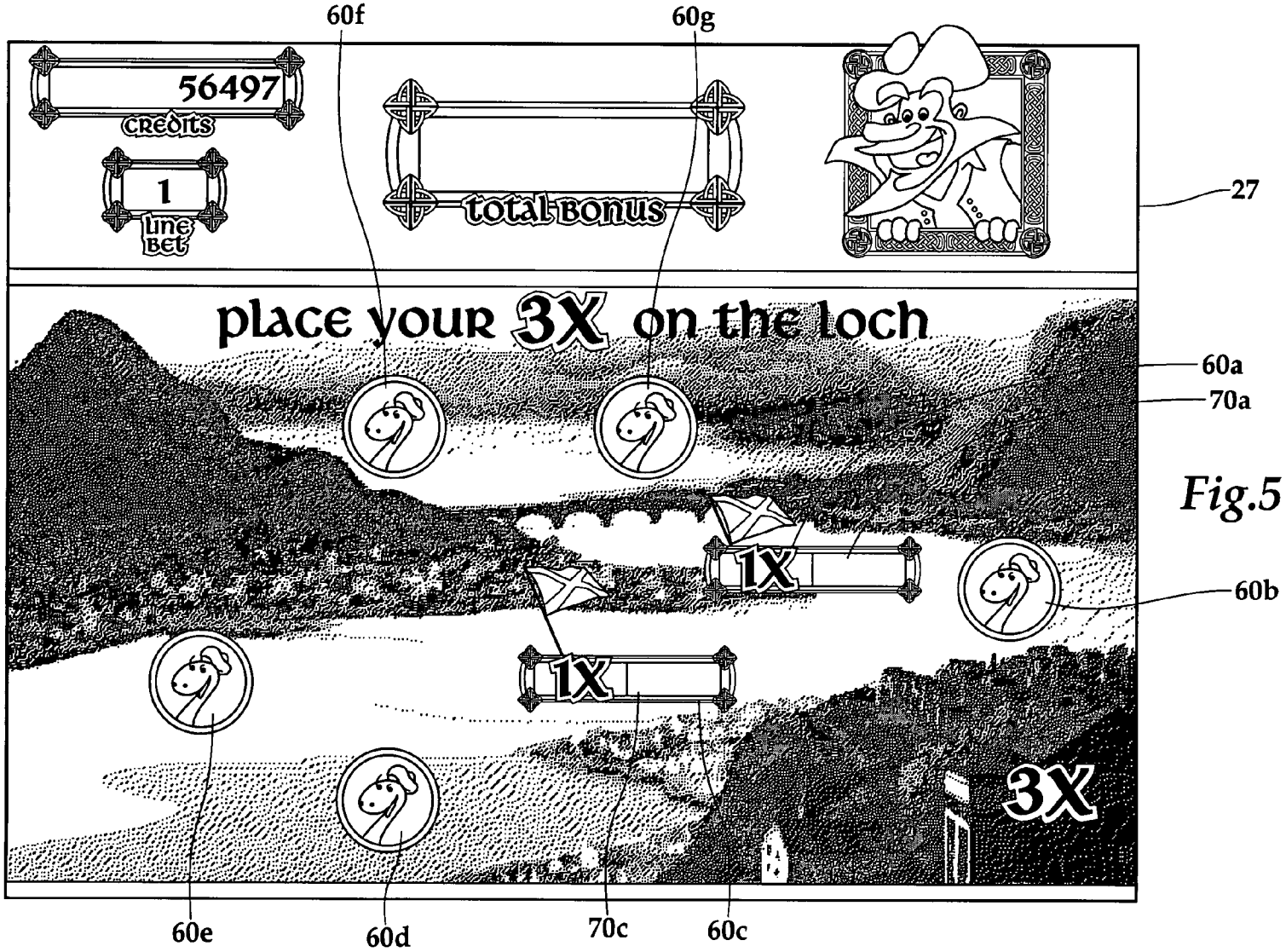
FIG. 5 illustrates a secondary display of a gaming terminal of FIG. 1 displaying one embodiment of a wagering game having selectable objects according to the present invention.
Figure 6:
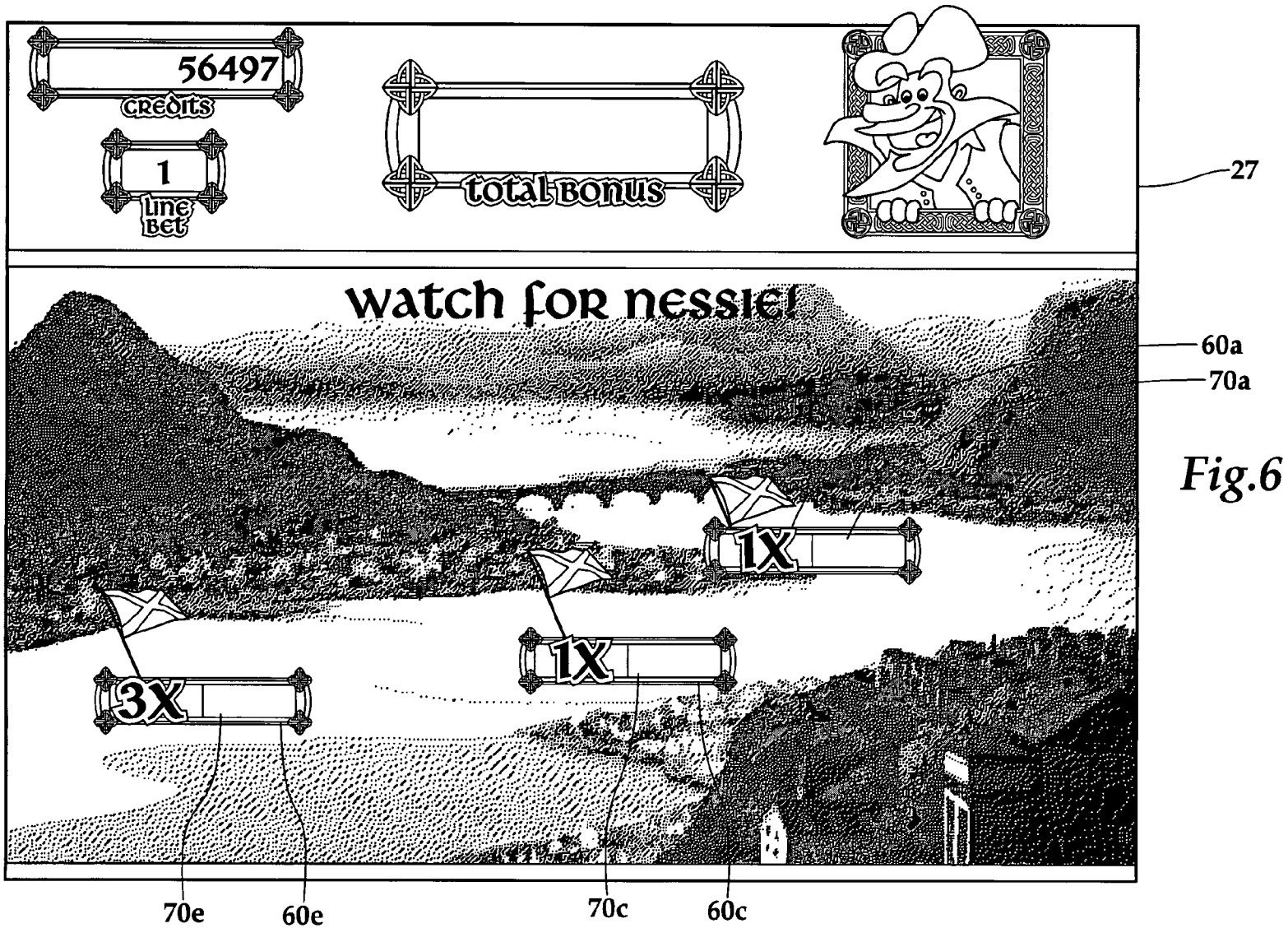
FIG. 6 illustrates a secondary display of a gaming terminal of FIG. 1 displaying one embodiment of a wagering game having selectable objects according to the present invention.

As shown in FIG. 4, selectable object 60*a* (not shown) is selected, and multiplier meter 70*a* is placed at that location. As the wagering game continues, a player or the CPU 30 is allowed to make another selection. As shown in FIG. 5, a selection is made of selectable object 60*c*. Multiplier meter 70*c* is placed at that location. A player or the CPU 30 can continue to make further selections until all selections have been made (based on an outcome in the basic game) or a stop-selection feature occurs. In FIG. 6, a selection is made of selectable object 60*e*, and a multiplier meter 70*e* is placed at that location.

Figure 7:
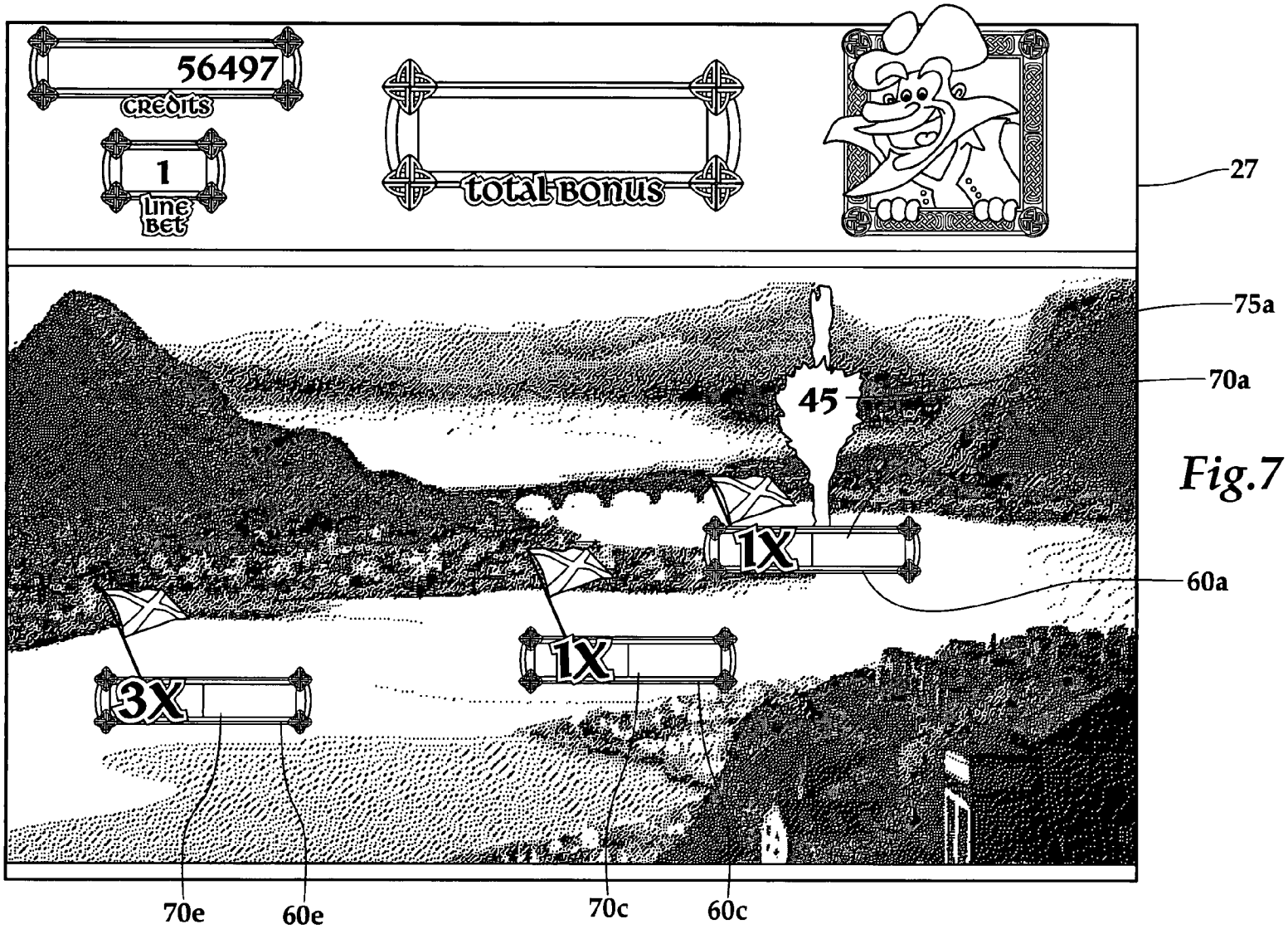
FIG. 7 illustrates a secondary display of a gaming terminal of FIG. 1 displaying one embodiment of a wagering game having bonus awards associated with selected objects that are revealed according to the present invention.

In the present example, once the three selections have been made, an event occurs that causes the bonus awards for the selected objects to be revealed. The event may be triggered after all selections have been made, or after some other outcome occurs. In the preferred embodiment shown in FIG. 7, after all three selections have been made, Nessie shoots a burst of water 75*a* that reveals a credit amount for the first selected selectable object 60*a*. In FIG. 7, for example, the burst of water 75*a* shows a bonus award of 45 credits. This award continues to change, however, as the burst of water 75*a* continues. The longer that the burst of water 75*a* lasts, the more the award amount will increase. When Nessie is finished, the final bonus award is displayed in the multiplier meter 70*a*.

Figure 8:
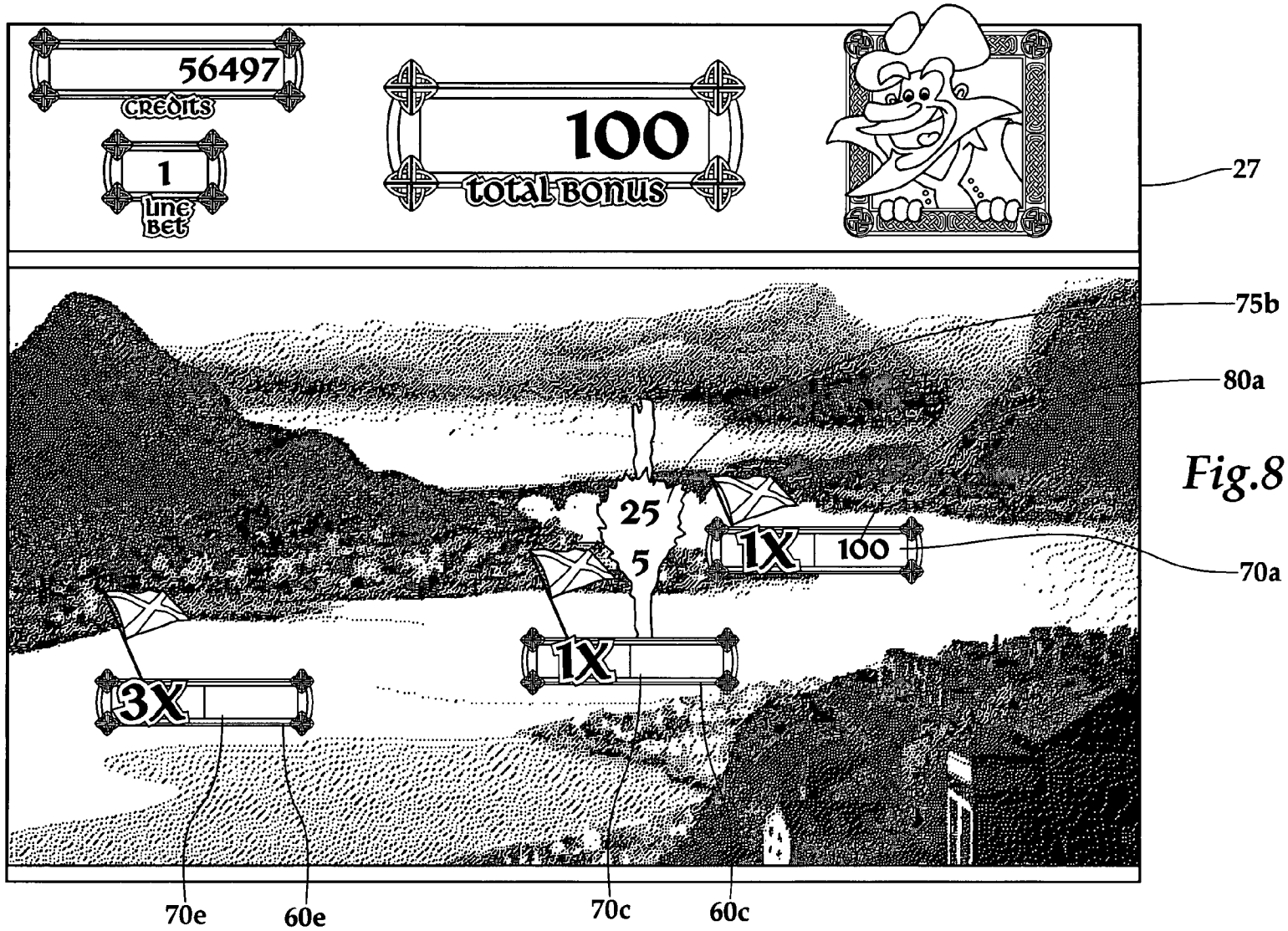
FIG. 8 illustrates a secondary display of a gaming terminal of FIG. 1 displaying one embodiment of a wagering game having bonus awards associated with selected objects that are revealed according to the present invention.
Figure 9:
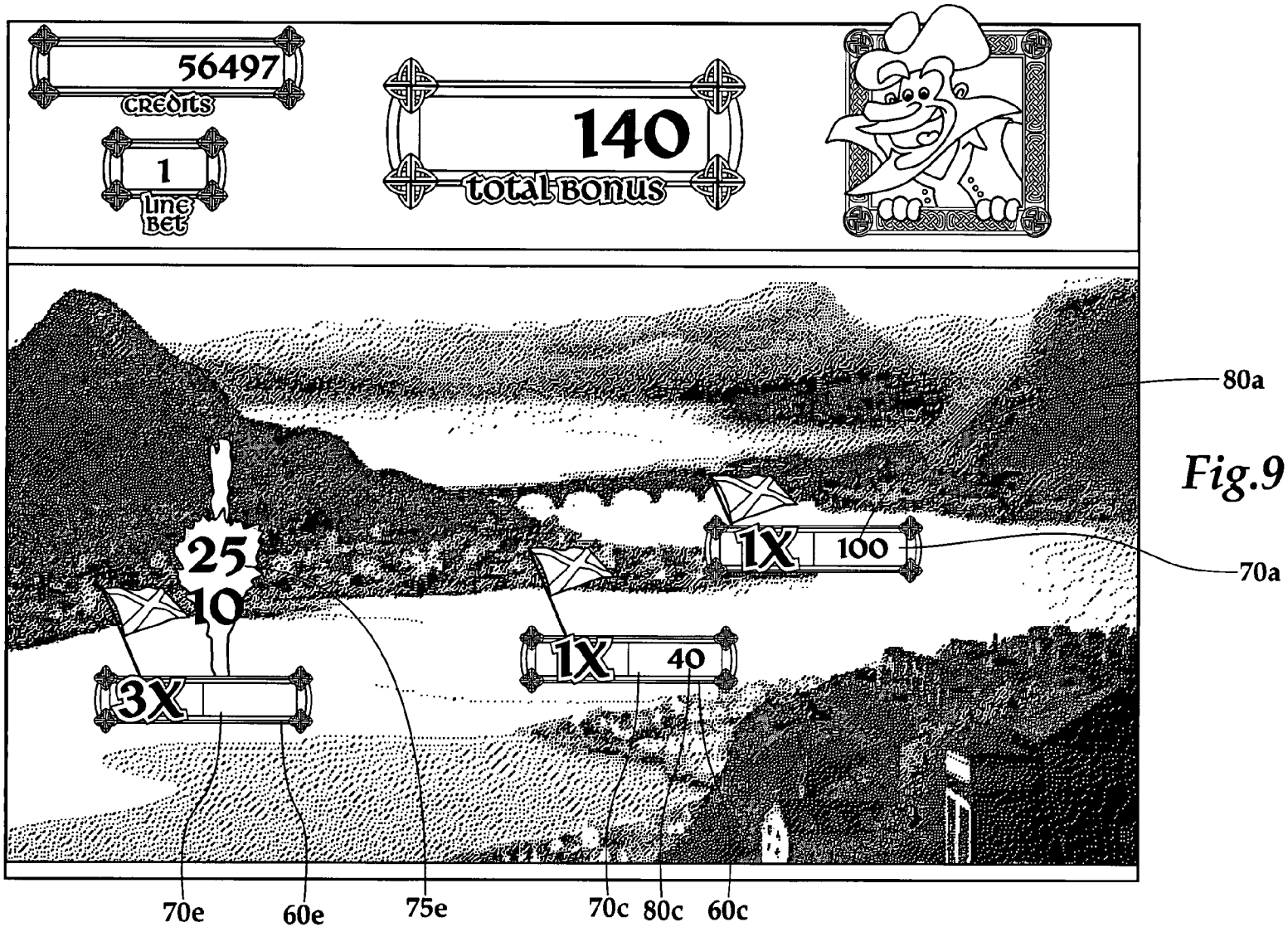
FIG. 9 illustrates a secondary display of a gaming terminal of FIG. 1 displaying one embodiment of a wagering game having bonus awards associated with selected objects that are revealed according to the present invention.
Figure 10:
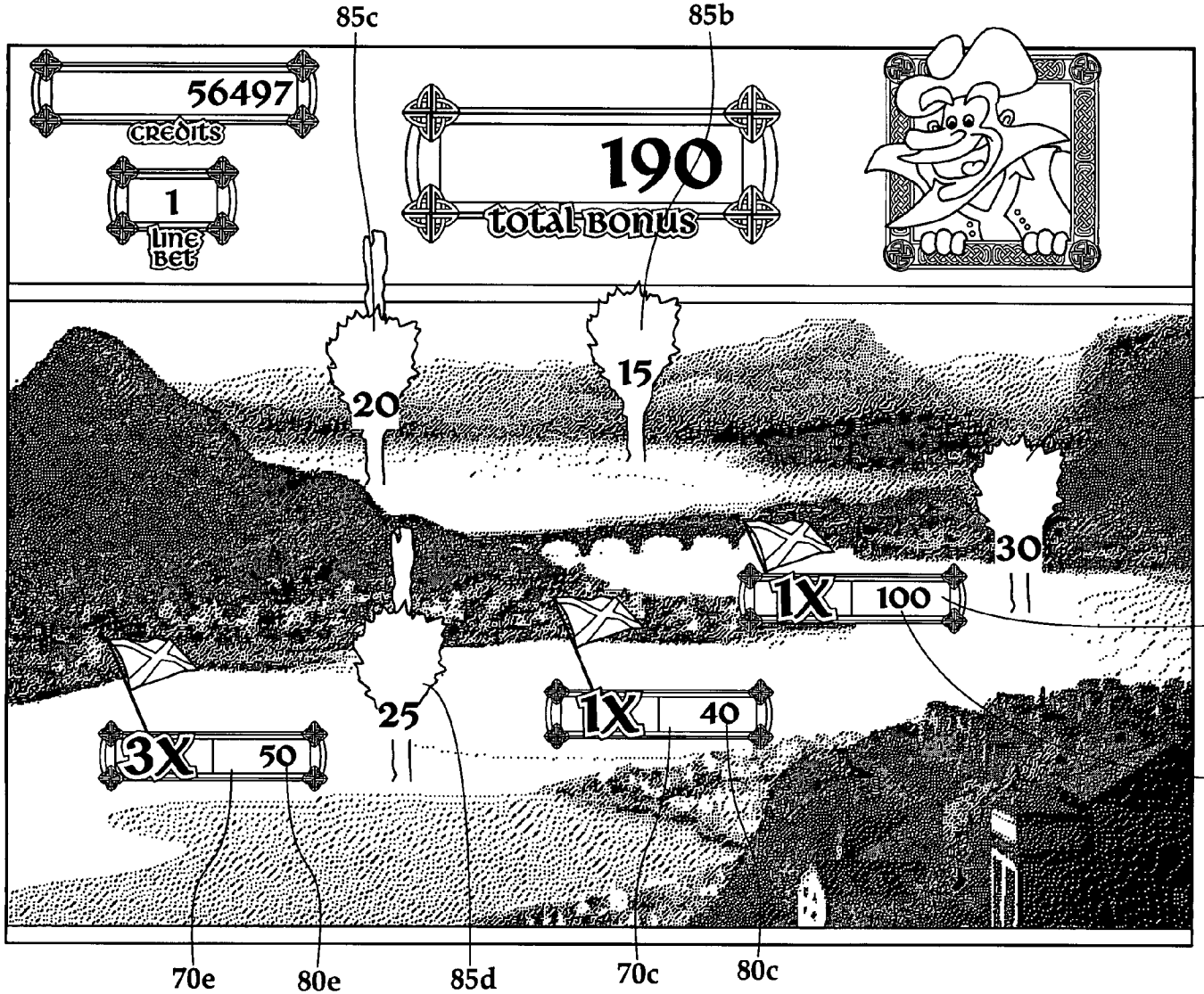
FIG. 10 illustrates a secondary display of a gaming terminal of FIG. 1 displaying one embodiment of a wagering game having bonus awards associated with non-selected objects that are revealed according to the present invention.

As shown in FIG. 8, the final bonus award 80*a* for the first selection is 100 credits. FIG. 8 also shows a burst of water 75*b* revealing the bonus award for the second selected selectable object 60*c*. The bonus amount continues to increase as the burst of water 75*b* continues. For example, the bonus award in FIG. 8 increases from 5 to 25, and continues to increase until it reaches 40, as shown in the multiplier meter 70*c* in FIG. 9. Thus, the final bonus award 80*c* for the second selected selectable object 60*c* is 40 credits. FIG. 9 also shows a third burst of water 75*e* with an increasing bonus award amount in the location of the third selected selectable object 60*e*. Here the bonus award amount is increasing from 10 to 25. The final bonus award 80*e* for the third selected selectable object 60*e* is 50 credits, as shown in multiplier meter 70*e* in FIG. 10. In addition to credits, the bonus award may also include free spins, or other prizes that could be awarded to a player.

Once the final bonus awards 80*a*, 80*c*, and 80*e* have been revealed in the multiplier meters 70*a*, 70*c*, and 70*e*, respectively, for the selected selectable objects 60*a*, 60*c*, and 60*e*, the bonus awards associated with the non-selected selectable objects 60*b*, 60*d*, 60*f*, and 60*g* (see FIG. 4) are revealed. For example, in FIG. 10, bursts of water 85*a*, 85*b*, 85*c*, and 85*d* in the locations of the non-selected objects 60*b*, 60*d*, 60*f*, and 60*g* reveal the associated bonus award amounts, i.e., 30, 15, 20 and 25, respectively.

In typical wagering games, once an award has been revealed to a player, in particular an award associated with a non-selected object, the bonus game ends. In the present invention, however, despite having revealed the awards of non-selected objects, a player experiences further game play via a post-reveal alteration feature. This feature allows the bonus awards associated with the selected objects to be altered to provide an adjusted bonus award that is different from, and preferably greater than, the original bonus award. The adjusted bonus award may be greater than, less than, or a multiple of the bonus award before alteration.

Figure 11:
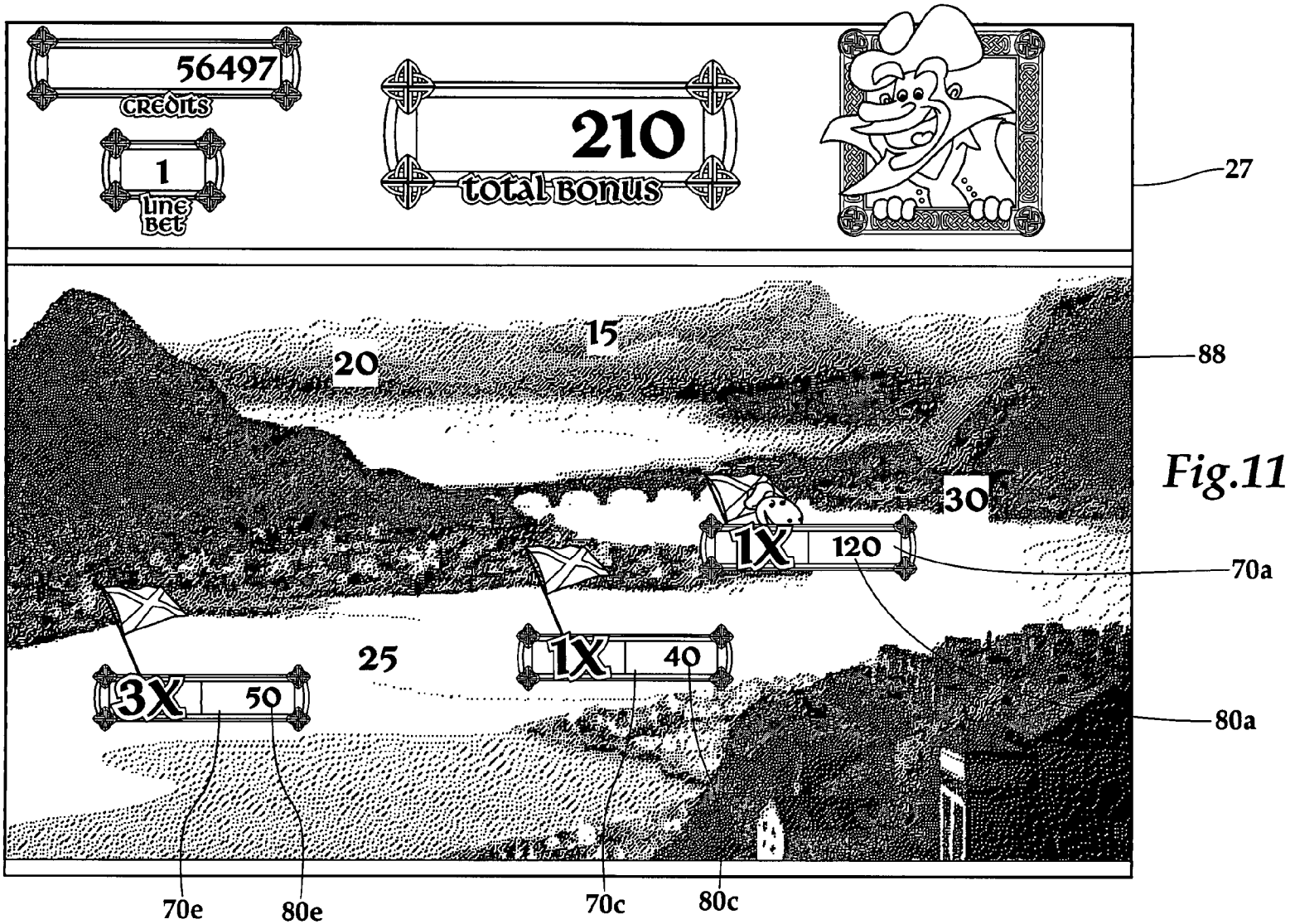
FIG. 11 illustrates a secondary display of a gaming terminal of FIG. 1 displaying one embodiment of a wagering game having a post-reveal alteration feature according to the present invention.

In the preferred embodiment shown in FIG. 11, the post-reveal alteration feature includes having Nessie 88 appear at some location in the loch. If she appears at any of the selectable objects 60 and peeks into the multiplier meter 70, the bonus award associated with that selection is altered. In FIG. 11, Nessie appears at selected selectable object 60*a*, peeks into the multiplier meter 70*a*, and the bonus award for that selection is increased from 100 to 120 credits. This alteration results in an incremental increase. The post-reveal alteration feature may be triggered by an outcome in the basic game, or by one or a combination of objects selected in the bonus game, or by some other random criteria. Alternatively, in other embodiments, the alteration of awards may occur at the same time that the awards are revealed.

Figure 12:
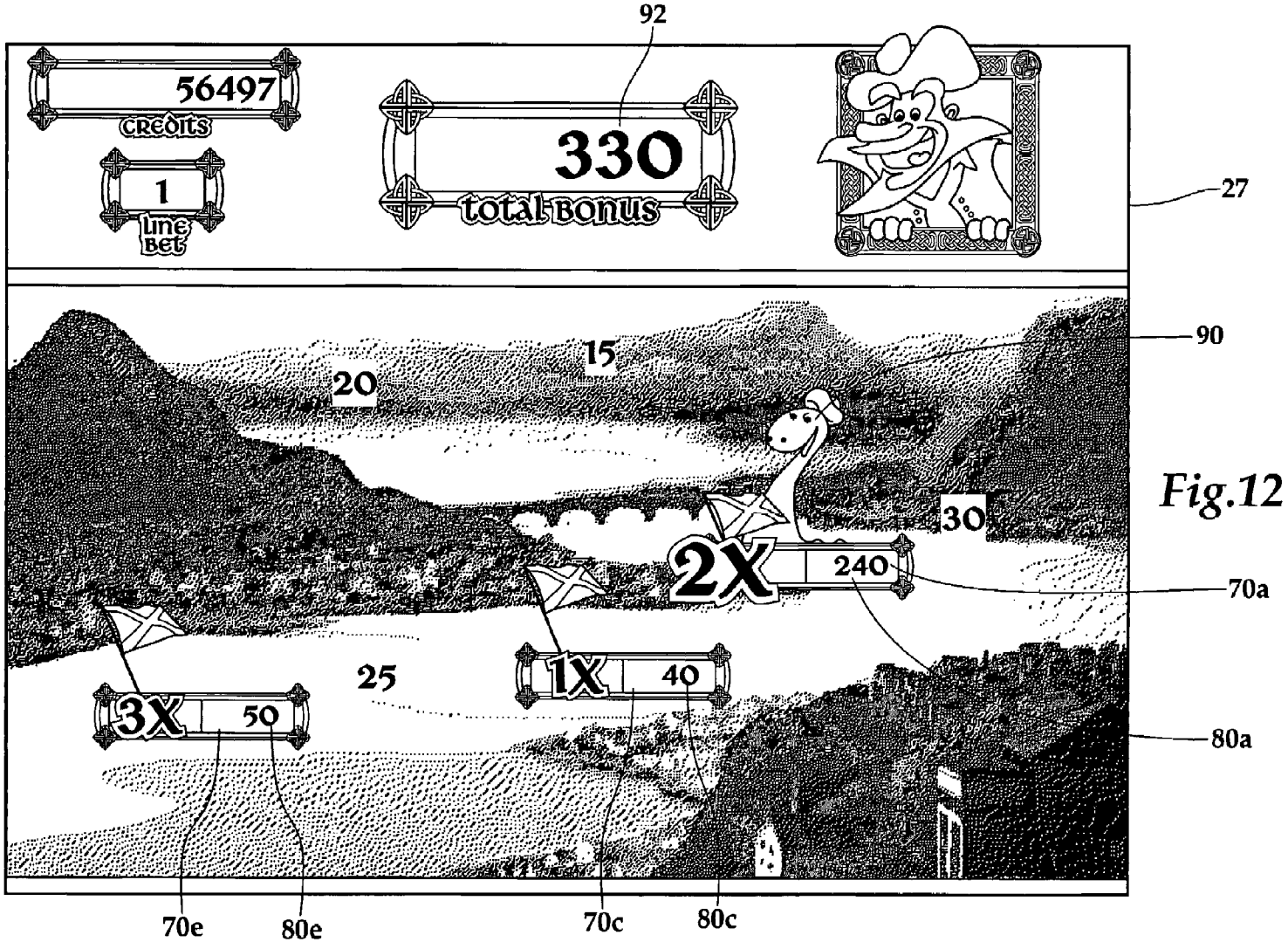
FIG. 12 illustrates a secondary display of a gaming terminal of FIG. 1 displaying one embodiment of a wagering game having a post-reveal alteration feature according to the present invention.

The post-reveal alteration feature can also include using a multiplier that multiplies the bonus award amount by a whole number. In the preferred embodiment of the present invention, as shown in FIG. 12, alteration of the bonus award occurs when Nessie fully appears at the multiplier meter of a previously selected object. For example, in FIG. 12, Nessie appears in full form 90 at multiplier meter 70*a*. The multiplier meter in this case has a corresponding multiplier of "2×." The bonus award is altered to reflect the effect of the "2×" multiplier. Thus, the adjusted bonus award is 240 credits.

The adjusted bonus award, as well as the other bonus awards that may or may not be altered, is included in the overall bonus award 92. As shown in FIG. 12, the overall bonus award 92 is 330 credits. Thus, a player receives an overall bonus award based on adjusted bonus awards that are greater than the bonus awards revealed before alteration. The player's gaming experience is, therefore, enhanced by the use of the post-reveal alteration feature to produce a larger bonus award. Furthermore, because the enhanced award occurs after all selections have been revealed, a player does not have to make further selections or risk money and/or credits in an attempt to get a larger bonus award.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gaming terminal for playing a wagering game, comprising:

a basic game having a plurality of symbols that indicate a randomly selected outcome that has been selected from a plurality of outcomes in response to a wager input by a player;

a bonus game having a plurality of selectable objects, said selectable objects associated with bonus awards, said bonus awards having bonus award values that are displayed upon selection; and wherein upon display of said bonus award values associated with selected objects, said bonus award values associated with non-selected objects are revealed, and wherein only after said bonus award values associated with said selected and non-selected objects are revealed, said displayed bonus award value associated with at least one of said selected objects undergoes a random alteration without player intervention to produce an adjusted bonus award value different from the displayed bonus award value associated with said at least one of said selected objects.

2. The gaming terminal of claim 1, further comprising an overall bonus award value based on said adjusted bonus award value.

3. The gaming terminal of claim 1, wherein said bonus game is triggered by a combination of said plurality of symbols corresponding to a bonus-game outcome.

4. The gaming terminal of claim 1, wherein said selection includes selecting at least one of said selectable objects.

5. The gaming terminal of claim 1, wherein said selection is made by said player.

6. The gaming terminal of claim 1, wherein said selection is made by a computer.

7. The gaming terminal of claim 1, wherein said selections are made until a stop-selection feature occurs in said bonus game.

8. The gaming terminal of claim 1, wherein said number of selections is based on said randomly selected outcome in said basic game.

9. The gaming terminal of claim 1, wherein said bonus game includes placement of at least one multiplier meter at one of said selected objects.

10. The gaming terminal of claim 9, wherein said multiplier meter displays said bonus award values associated with said selected objects.

11. The gaming terminal of claim 9, wherein said multiplier meter is associated with a multiplier value.

12. The gaming terminal of claim 1, further comprising an event that causes said bonus award values for said selected objects to be displayed.

13. The gaming terminal of claim 12, wherein said event includes displaying a character, an act or a combination thereof.

14. The gaming terminal of claim 12, wherein the longer the event occurs, the greater said bonus award value becomes.

15. The gaming terminal of claim 1, further comprising an event that causes said bonus award values for said non-selected objects to be revealed.

16. The gaming terminal of claim 15, wherein said event includes displaying a character, an act or a combination thereof.

17. The gaming terminal of claim 1, wherein said random alteration produces at least one adjusted bonus award value that is greater than said bonus award value before said random alteration.

18. The gaming terminal of claim 1, wherein said random alteration produces at least one adjusted bonus award value that is less than said bonus award value before said random alteration.

19. The gaming terminal of claim 1, wherein said random alteration produces at least one adjusted bonus award value that is a multiple of said bonus award value before said random alteration.

20. The gaming terminal of claim 1, wherein said random alteration is influenced by said randomly selected outcome in said basic game.

21. The gaming terminal of claim 1, wherein said random alteration is influenced by selection of one or a combination of selectable objects selected in said bonus game.

22. The gaming terminal of claim 1, wherein said random alteration is preceded by an event involving a character, an act or a combination thereof.

23. The gaming terminal of claim 1, wherein said bonus award value includes credits, free spins, multipliers or access to other wagering games.

24. The gaming terminal of claim 1, wherein said adjusted bonus award value and said displayed bonus award value that is altered to produce said adjusted bonus award value are respective numbers and are of a same award type, said number of said adjusted bonus award value resulting from an increase or decrease in said number of said displayed bonus award value.

25. The gaming terminal of claim 24, wherein said award type is one of credits, multipliers, and free spins.

26. A method of playing a wagering game having a basic game and a bonus game, comprising:

conducting said basic game at a gaming terminal, said basic game having a plurality of symbols that indicate a randomly selected outcome that has been selected from a plurality of outcomes in response to a wager input by a player;

achieving a bonus-game outcome as said randomly selected outcome, said bonus-game outcome providing a plurality of selectable objects in said bonus game, each of said selectable objects associated with a bonus award, the bonus award having a bonus award value;

receiving a selection of at least one of said plurality of selectable objects, displaying said bonus award value associated with each of said selected objects;

revealing said bonus award value associated with each of said non-selected objects; and after displaying said bonus award value associated with each of said selected objects and revealing said bonus award value associated with each of said non-selected objects, randomly altering, without player intervention, said displayed bonus award value associated with at least one of said selected objects to provide an adjusted bonus award value different from said displayed bonus award value associated with said at least one of said selected objects.

27. The method of claim 26, further comprising awarding an overall bonus award value based on said adjusted bonus awards.

28. The method of claim 26, wherein said achieving said bonus-game outcome includes achieving a combination of said plurality of symbols corresponding to said bonus-game outcome.

29. The method of claim 26, wherein said receiving a selection includes receiving a selection of at least one of said selectable objects.

30. The method of claim 26, wherein said selection is made by said player.

31. The method of claim 26, wherein said selection is made by a computer.

32. The method of claim 26, wherein said receiving a selection occurs until a stop-selection feature occurs in said bonus game.

33. The method of claim 26, wherein said number of selections received is based on said randomly selected outcome in said basic game.

34. The method of claim 26, further comprising placing at least one multiplier meter at one of said selected objects.

35. The method of claim 34, wherein said multiplier meter displays said bonus award value associated with said selected objects.

36. The method of claim 35, wherein said multiplier meter is associated with a multiplier value.

37. The method of claim 26, further comprising providing an event that causes said bonus award values for said selected objects to be displayed.

38. The method of claim 37, wherein said event includes displaying a character, an act or a combination thereof.

39. The method of claim 37, wherein the longer the event occurs, the greater said bonus award value becomes.

40. The method of claim 26, further comprising providing an event that causes said bonus award values for said non-selected objects to be revealed.

41. The method of claim 40, wherein said event includes displaying a character, an act or a combination thereof.

42. The method of claim 26, wherein said random altering produces at least one adjusted bonus award value that is greater than said bonus award value before said random alteration.

43. The method of claim 26, wherein said random altering produces at least one adjusted bonus award value that is less than said bonus award value before said random alteration.

44. The method of claim 26, wherein said random altering produces at least one adjusted bonus award value that is a multiple of said bonus award value before said random alteration.

45. The method of claim 26, wherein said random altering is influenced by said randomly selected outcome in said basic game.

46. The method of claim 26, wherein said random altering is influenced by the selection of one or a combination of selectable objects selected in said bonus game.

47. The method of claim 26, wherein said random altering is preceded by an event involving a character, an act or a combination thereof.

48. The method of claim 26, wherein said bonus award value includes credits, free spins, multipliers or access to other wagering games.

49. The method of claim 26, wherein said adjusted bonus award value and said displayed bonus award value that is altered to produce said adjusted bonus award value are respective numbers and are of a same award type, said number of said adjusted bonus award value resulting from an increase or decrease in said number of said displayed bonus award value.

50. The method of claim 49, wherein said award type is one of credits, multipliers, and free spins.

51. A method of playing a wagering game, comprising machine implemented steps of:

displaying a plurality of selectable objects on at least one display, each selectable object being associated with an award, each award having an award value;

selecting at least one of said plurality of selectable objects;

displaying said award value associated with each selected object on the at least one display;

revealing said award value associated with each non-selected object on the at least one display; and after displaying said award value associated with each selected object and revealing said award value associated with each non-selected object, using a processor to randomly alter, without player intervention, said displayed award value associated with at least one of said selected objects, said randomly-altered award value being revealed only after said award values associated with said selected and non-selected objects are revealed, wherein said randomly-altered award value is different from said displayed award value associated with said at least one of said selected objects.

52. The method of claim 51, wherein said wagering game includes a basic game and a bonus game.

53. The method of claim 51, further comprising the step of awarding an overall award value based on said altered awards.

54. The method of claim 51, wherein said selecting is performed by a player.

55. The method of claim 51, wherein said selecting is performed by a computer.

56. The method of claim 51, wherein said selecting is performed until a stop-selection feature occurs.

57. The method of claim 51, further comprising placing at least one multiplier meter at one of said selected objects.

58. The method of claim 52, wherein said randomly altering is influenced by a randomly selected outcome in said basic game.

59. The method of claim 52, wherein said randomly altering is influenced by the selection of said selectable objects in said bonus game.

60. The method of claim 51, wherein said randomly altering is preceded by an event involving a character, an act or combination thereof.

61. The method of claim 51, wherein said randomly-altered award value and said displayed award value that is altered to produce said randomly-altered award value are respective numbers and are of a same award type, said number of said randomly-altered award value resulting from an increase or decrease in said number of said displayed award value.

62. The method of claim 61, wherein said award type is one of credits, multipliers, and free spins.

63. A gaming terminal for playing a wagering game, comprising:

a display for displaying a plurality of selectable objects, each selectable object being associated with an award;

a controller coupled to said display and operative to control selection of at least one of said plurality of selectable objects;

display of an award value associated with each selected object;

revelation of award values associated with non-selected objects; and after display of said award value associated with each selected object and said revelation of said award values associated with said non-selected objects, alteration, without player intervention, of at least one of said award values associated with selected objects to provide an adjusted award value different from said award value associated with said at least one of said selected objects, said adjusted award value being revealed only after said award values associated with said selected and non-selected objects are revealed.

64. The gaming terminal of claim 63, wherein said wagering game includes a basic game and a bonus game.

65. The gaming terminal of claim 63, further comprising an overall award value based on said adjusted awards.

66. The gaming terminal of claim 63, wherein said selection is performed by a player.

67. The method of claim 63, wherein said selection is performed by a computer.

68. The method of claim 63, wherein said selection is performed until a stop-selection feature occurs.

69. The method of claim 63, further comprising placement of at least one multiplier meter at one of said selected objects.

70. The method of claim 64, wherein said alteration is influenced by a randomly selected outcome in said basic game.

71. The method of claim 64, wherein said alteration is influenced by the selection of said selectable objects in said bonus game.

72. The method of claim 63, wherein said alteration is preceded by an event involving a character, an act or combination thereof.

73. The gaming terminal of claim 63, wherein said adjusted award value and said award value that is altered to produce said adjusted award value are respective numbers and are of a same award type, said number of said adjusted award value resulting from an increase or decrease in said number of said award value.

74. The gaming terminal of claim 73, wherein said award type is one of credits, multipliers, and free spins.

75. A method of playing a wagering game, comprising machine implemented steps of:

displaying a plurality of selectable objects on at least one display, each selectable object being associated with an award value;

selecting at least one of said plurality of selectable objects;

displaying said award value associated with each selected object on the at least one display; and after displaying said award value associated with each selected object, revealing said award value associated with each non-selected object on the at least one display and thereafter using a processor to randomly alter, without player intervention, said displayed award value associated with at least one of said selected objects, to produce a randomly-altered award value different from said displayed award value associated with said at least one of said selected objects.

76. The method of claim 75, wherein said randomly-altered award value and said displayed award value that is randomly altered to produce said randomly-altered award value are respective numbers and are of a same award type, said number of said randomly-altered award value resulting from an increase or decrease in said number of said displayed award value.

77. The method of claim 76, wherein said award type is one of credits, multipliers, and free spins.

* * * * *